United States Patent [19]

Maxel

[11] Patent Number: 4,618,149

[45] Date of Patent: Oct. 21, 1986

[54] GOLF CLUB HAVING INTERCHANGEABLE FACE PLATES

[76] Inventor: John M. Maxel, 38W580 W. Mary La., St. Charles, Ill. 60174

[21] Appl. No.: 618,245

[22] Filed: Jun. 7, 1984

[51] Int. Cl.[4] ..... A63B 53/08; A63B 53/06

[52] U.S. Cl. ..... 273/79; 273/175; 273/171; 273/167 H

[58] Field of Search ..... 273/79, 175, 171, 167 H, 273/173, 174, 167 C, 167 F, 167 H, 167 J

[56] References Cited

U.S. PATENT DOCUMENTS

| | | | |
|---|---|---|---|
| 1,133,129 | 3/1915 | Govan | 273/171 |
| 2,056,335 | 10/1936 | Wettlaufer | 273/79 |
| 2,201,638 | 5/1940 | Thiebault | 273/79 |
| 2,705,147 | 3/1955 | Winter | 273/167 H |
| 3,368,812 | 2/1968 | Baldwin | 273/173 X |
| 3,941,390 | 3/1976 | Hussey | 273/171 X |
| 4,313,607 | 2/1982 | Thompson | 273/167 H |
| 4,432,549 | 2/1984 | Zebelean | 273/167 H |

FOREIGN PATENT DOCUMENTS

| | | | |
|---|---|---|---|
| 211781 | 1/1957 | Australia | 273/167 H |
| 595117 | 1/1978 | Switzerland | 273/167 H |

*Primary Examiner*—George J. Marlo
*Attorney, Agent, or Firm*—Mason, Kolehmainen, Rathburn & Wyss

[57] ABSTRACT

A novel golf club includes an elongated metal shaft and a metal club head secured to a lower end portion thereof. The club head comprises an integrally molded body having a hollow interior with an opening outwardly onto a planar front face. A plurality of metal face plates, each having a planar back face with an outer periphery matching the periphery of the front face of the club head body are adapted to be mounted on the body closing off the hollow opening thereof and secured in place with fasteners. Each face plate includes a ball engaging outer face having a set of characteristics comprising a curved bulge from toe to heel, a curved roll from bottom to top and a degree of angular loft relative to a bottom edge, and at least one of the characteristics of a selected face plate is different from that of the other(s) to impart a different path to a ball when struck thereby. The top and bottom walls, and the toe and heel portions of the club head taper from a minimum thickness rearwardly of the front face to a maximum thickness at the front face around the hollow opening.

6 Claims, 11 Drawing Figures

Fig. 6
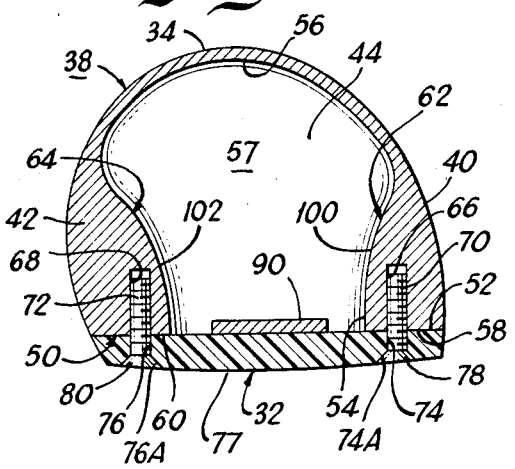
Fig. 7
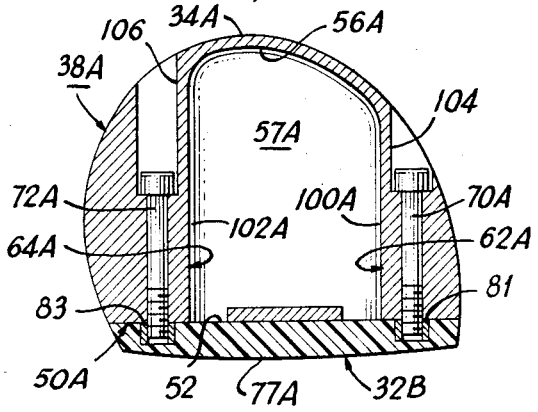
Fig. 8
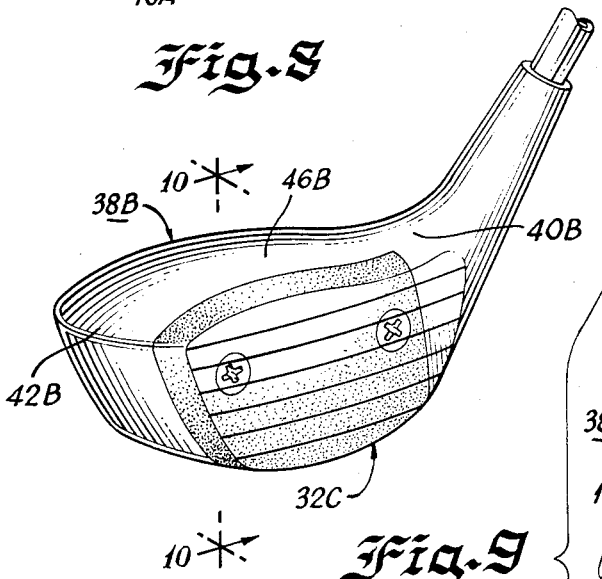
Fig. 9
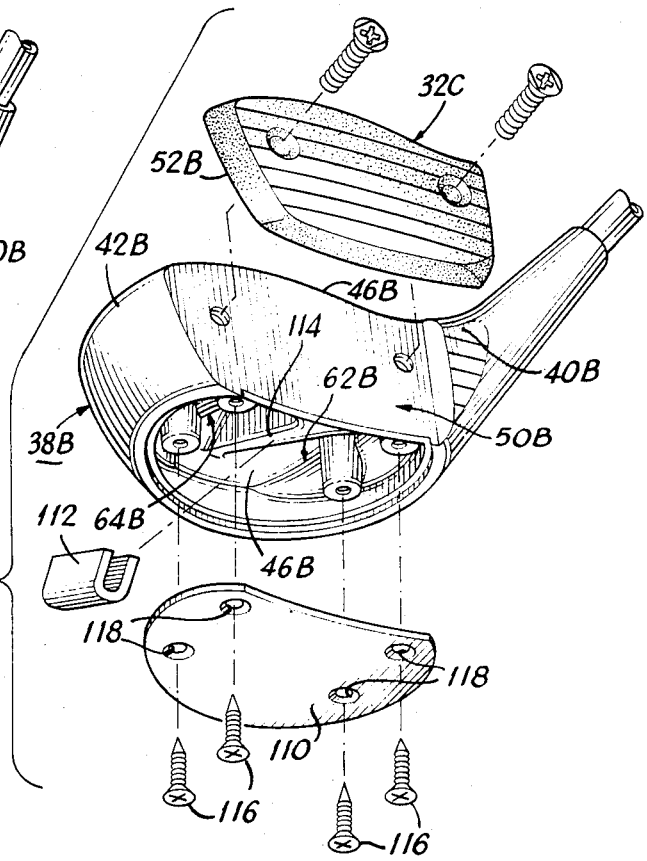
Fig. 10
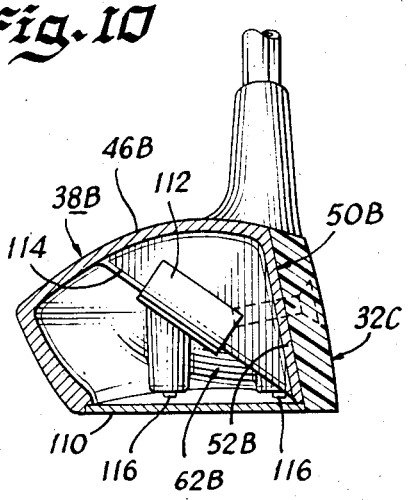
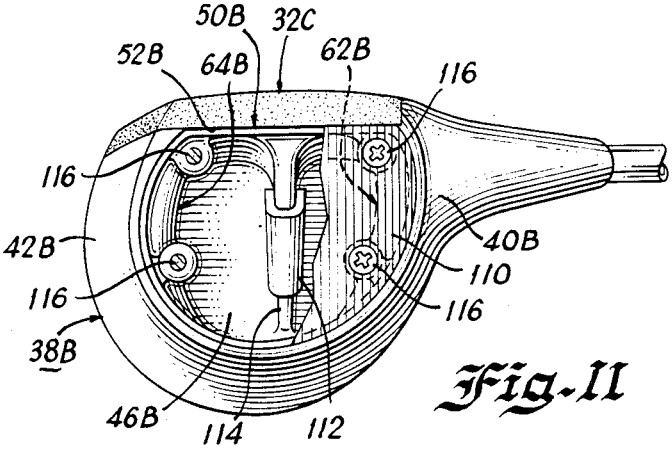
Fig. 11

GOLF CLUB HAVING INTERCHANGEABLE FACE PLATES

FIELD OF THE INVENTION

The present invention is directed to a golf club, and particularly a "wood", having a plurality of exchangeable face plates, particularly adapted for a metal, e.g. aluminum, stainless steel, magnesium, polymeric on composite polymers, such as epoxy reinforced with graphite-fiber reinforcement hollow-core wood. A plurality of face plates are provided so that a desired face plate can be secured to the face of the golf club to provide different degrees of loft, bulge, roll and/or weight. Further, a weight can be secured to a hollow head of hollow woods to provide a desired different center of gravity or overall swing weight to the club.

BACKGROUND OF THE INVENTION AND PRIOR ART

In accordance with U.S. Golf Association Rules governing golf clubs, rule 2.a "the golf clubs shall be composed of a shaft and a head, and all of the various parts shall be fixed so that the club is one unit; the club shall not be designed to be adjustable except for weight".

By definition, a "wood" club is one with a head relatively broad from face to back, and usually made of wood, plastic or a light metal. The degrees of loft on each wood numbered 1–5 vary significantly from manufacturer to manufacturer, presently as set forth below:

chanically altered by filing the club face with great skill and workmanship. Great care, skill, workmanship and time is required to alter the loft, bulge, and/or roll of a particular wood since altering the facing on any wood in any respect (loft, bulge or roll) alters the other specifications as well in addition to the swing weight of the club. Filing of the club face to alter loft, bulge, or roll also generally requires cutting new face lines into the club face.

Because of the skill, workmanship and effort required to alter a fixed face on a golf club, and the desirability of changing the facing specifications on a given golf club for a particular golf enthusiast, others have developed golf clubs having quickly adjustable facings. Examples of clubs having quickly changeable face specifications are as follows: U.S. Pat. Nos. 2,026,749; 2,056,335; 2,175,598; 2,201,638; 2,386,552; 3,190,651; and 3,368,812.

In accordance with rule 2 clause (a) of the U.S. Golf Association Rules, "the club shall not be designed to be adjustable, except for weight". Rule 2-2(b) states that playing characteristics are not to be changed during a round. Accordingly, the quickly changeable golf clubs described in the above listed United States Patents, do not comply with the United States Golf Association Rules and are therefore only useful for experimentation purposes. The Clark U.S. Pat. No. 2,750,194 describes a wooden golf club having a weight adjustment. This club apparently complies with rule 2 clause (a), but the Clark Pat. No. 2,750,194 does not disclose a golf club

GOLF CLUB MANUFACTURERS' STANDARD SPECIFICATIONS - LOFT (MENS)

| Mfgr. | #1 Wood | #2 Wood | #3 Wood | #4 Wood | #5 Wood | #2 Iron | #3 Iron | #4 Iron | #5 Iron | #6 Iron | #7 Iron | #8 Iron | #9 Iron | Pitch Wedge | Sand Wedge |
|---|---|---|---|---|---|---|---|---|---|---|---|---|---|---|---|
| Acushnet | 11 | 14 | 17 | 20 | 22 | 22 | 25 | 28 | 31 | 35 | 39 | 43 | 47 | 51 | 55 |
| Dunlop | 11 | 14 | 17 | 19 | 22 | 21 | 24 | 28 | 32 | 36 | 40 | 44 | 48 | 52 | 56 |
| Faultless | 12 | — | 15 | 18 | 21 | 20 | 24 | 28 | 32 | 36 | 40 | 44 | 48 | 52 | 56 |
| H & B | 11 | 13 | 16 | 19 | 21 | 20 | 24 | 28 | 32 | 36 | 40 | 44 | 48 | 52 | 58 |
| MacGregor | 11 | 13 | 15½ | 18½ | 22 | 22 | 25 | 28 | 32 | 36 | 38½ | 43 | 45 | 49 | 56 |
| No'western | 11 | 14 | 16 | 19 | 22 | 21 | 24 | 27 | 31 | 35 | 39 | 43 | 47 | 51 | 55 |
| P.G.A. | 11 | 14 | 17 | 20 | 22 | 21 | 23 | 26 | 29 | 33 | 37 | 41 | 45 | 50 | 54 |
| F'st Flight | 12½ | 14 | 17 | 20 | 23 | 21 | 24 | 27 | 31 | 35 | 39 | 43 | 47 | 51 | 55 |
| Pro-Dyne | 12 | — | 16½ | 19½ | 22½ | 21 | 24 | 27 | 30 | 34 | 38 | 42 | 46 | 51 | 57 |
| Ram | 11 | — | 16.5 | 19.2 | 22 | 21 | 24.3 | 27.8 | 31.5 | 35.3 | 39.2 | 43.3 | 47.5 | 51.6 | 56.7 |
| Royal | 11 | 14 | 17 | 19 | 21 | 21 | 24 | 27 | 31 | 35 | 39 | 43 | 47 | 51 | 57 |
| Spalding | 11 | 13 | 16 | 19 | 22 | 20 | 23 | 27 | 31 | 35 | 39 | 43 | 47 | 52 | 58 |
| Hagen | 11 | 16 | 17 | 19 | 21 | 21 | 24 | 27 | 31 | 35 | 39 | 43 | 47 | 51 | 55 |
| Wilson | 11 | 14 | 16 | 19 | 21 | 21 | 24 | 27 | 31 | 35 | 39 | 43 | 47 | 51 | 55 |

A change in loft on a particular numbered wood sometimes enables a golfer to perform better with a particular club and, instead of purchasing that numbered wood from a different manufacturer having the desired loft, or instead of purchasing another complete set of woods to obtain a particular wood having a desired loft, the loft on a given wood can be altered. Wood lofts can be altered mechanically by fastening the head of the club securely in a vice and hand filing the face of the club with short firm strokes to try to prevent file slippage and consequent head damage. This procedures requires great expertise and workmanship since any removal of material from the face of the club requires great care so that the bulge or roll of the club head are not unintentionally changed. Further, removal of material from the face of the club alters the swing weight of the club. The loft, bulge, and roll are shown in the drawing and labelled Prior Art.

Similarly, a golfer often finds that his game can be improved by changing the bulge and/or the roll of a particular wood club. The bulge and roll can be mecapable of being adjusted at the facing in loft, bulge or roll.

Others have experimented with face plates of various metals of high modulus of elasticity permanently bonded to the face of the club, such as stainless steel and the like, as disclosed in the Lynn Pat. No. 3,567,228. Another patent, Aitken Pat. No. 1,525,352 discloses a permanently secured face plate of desired loft having a properly balanced weight secured within the club head. Pat. No. 4,121,832 to Ebbing, discloses a golf putter having a removable and invertable face plate and removable weights to change the loft and swing weight of the putter.

SUMMARY OF THE INVENTION

In brief, the present invention is directed to a new and improved golf club; a new and improved golf club kit; and a new and improved method of manufacturing a golf club wherein the club head is attachable to a plurality of removable and interchangeable face plates having varied specifications of loft, bulge, material, and/or roll.

In accordance with one important embodiment of the present invention, the club head walls are enlarged or the club head otherwise weighted at a toe portion and a heel portion to weight the heel and toe portions surrounding a lighter weight cavity or central core of the club head. The heel and toe portions include fastener receiving means for receiving fasteners extending through the interchangeable face plates so that any desired face plate can be secured to the club head at the heel and toe portions.

Enlarged heel and toe walls of the club head provide an enlarged "sweet spot" dimension extending over a greater length of the club face so that even the inexperienced golfer can achieve better golf ball control and placement using the golf clubs of the present invention. Further, because the heel and toe portions of the golf clubs of the present invention are substantially heavier than a central core portion of the club head via greater wall thickness at the heel and toe portions of the golf club head, when a ball is struck at an off center position on the club face, the golf clubs of the present invention have less tendency to pivot to cause a slice or a hook on the golf ball. The interchangeable face plates are manufactured having at least one different specification so that a golfer can interchange face plates to provide a different loft, bulge, roll and/or golf ball striking material for any given wood type golf club.

Accordingly, an object of the present invention is to provide a wood type golf club having a plurality of interchangeable face plates.

Another object of the present invention is to provide a wood type golf club having a plurality of removable and interchangeable face plates removably connected to the club head wherein the club head has enlarged and relatively dense heel and toe portions.

Still another object of the present invention is to provide a golf club kit including a wood type golf club having a metal head and a plurality of interchangeable face plates each having at least one different specification of loft, bulge, and/or roll.

Another object of the present invention is to provide a wood type golf club having a plurality of removable and interchangeable face plates having ball striking surfaces made of different materials.

Accordingly, an object of the present invention is to provide a new and improved golf club head having a removable face plate and having a metal heel portion and a metal toe portion substantially heavier than a central core portion.

Another object of the present invention is to provide a new and improved wood type golf club having an elongated shaft and a metal club head having a removable face plate wherein the heel and toe portions of the club head each include a fastener receiving member for attachment of an interchangeable face plate.

Still another object of the present invention is to provide a new and improved golf club including a metal club head formed of materials at the club head toe portion and club head heel portion having substantially greater density than a club head core volume defined between the heel and toe portions of the club head.

Another object of the present invention is to provide a new and improved golf club including a plurality of interchangeable face plates, each face plate having at least one different specification than the specifications of the other face plates.

Still another object of the present invention is to provide a new and improved golf club having a metal golf club head including inner solid members extending from integral interior club head heel and toe walls, said solid members being elongated, curvilinear inner heel and toe wall extensions extending toward a central club head core portion.

Another object of the present invention is to provide a new and improved golf club head having a substantially larger "sweet-spot" area on the club head face.

Another object of the present invention is to provide a golf club kit including a wood type golf club having a metal head and a plurality of face plates with different specifications, the face plates being interchangeable on the metal head and removably secureable thereto.

Still another object of the present invention is to provide a method of manufacturing a golf club.

Another object of the present invention is to provide a new and improved method of manufacturing a golf club including casting metal in a general shape of a wood type club head while providing substantially more metal in the heel and toe areas than at back, top and bottom wall portions to concentrate the swing weight of the club head at the heel and toe portions.

The foregoing and other objects of the present invention will be more fully understood from the following description when read in conjunction with the accompanying drawings.

BRIEF DESCRIPTION OF THE DRAWINGS

FIG. 6 is a plan sectional view of the golf club head of FIG. 4 taken along the line 6—6 of FIG. 4;

FIG. 7 is a view similar to FIG. 6 showing another embodiment for mounting a face plate onto the golf club heads manufactured in accordance with the present invention;

FIG. 8 is a perspective view of another embodiment of a golf club head manufactured in accordance with the principles of the present invention;

FIG. 9 is an exploded perspective view of the golf club head of FIG. 8;

FIG. 10 is a cross-sectional view of the golf club head of FIGS. 8 and 9 taken along line 10—10 of FIG. 8; and FIG. 11 is a bottom view of the golf club head of FIG. 8 showing the sole plate of the club head partially broen away.

DETAILED DESCRIPTION OF THE PREFERRED EMBODIMENTS

Figure 1:
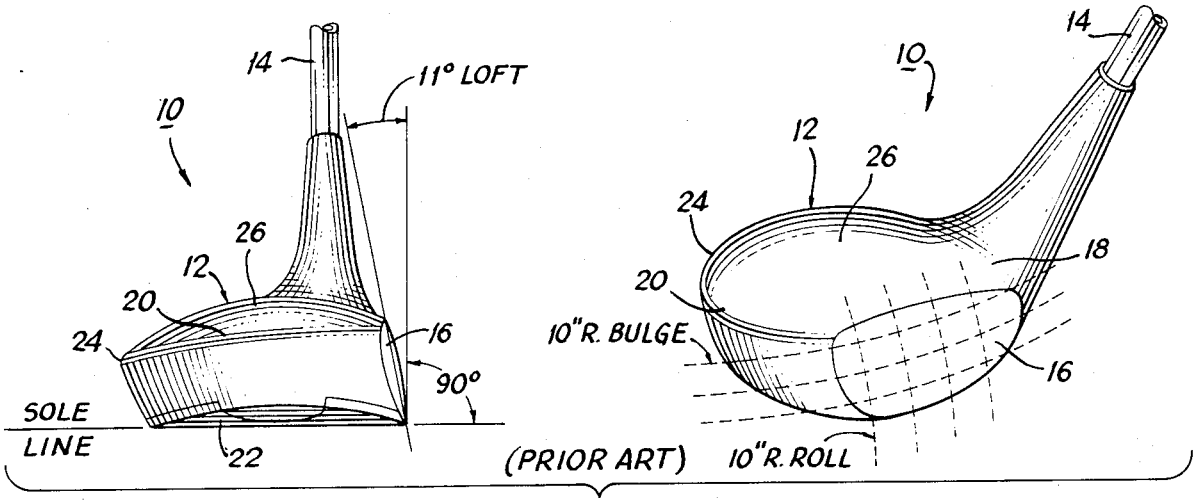
FIG. 1 includes a front view and a perspective view of a prior art golf club showing measurement of a club face "loft", "bulge", and "roll"

Turning now to the drawings, and initially to FIG. 1, there is illustrated a prior art golf club head having a ball-contacting face with specifications of 11° loft, 10 inch radius bulge, and 10 inch radius roll. As shown in FIG. 1, the wood-type golf club generally designated as 10 includes a club head generally designated 12 connectible to an elongated shaft 14. The club head 12 includes a face 16; a heel portion 18; a toe portion 20; a sole or lower wall portion 22; a curved or arcuate back wall portion 24 extending between the heel portion 18 and the toe portion 20; and an upper wall portion 26 comprising an upper surface of the club head, defined and bounded by an upper surface of the face 16, the heel portion 18, the toe portion 20, and the upper surface of the back wall portion 24.

Figure 2:
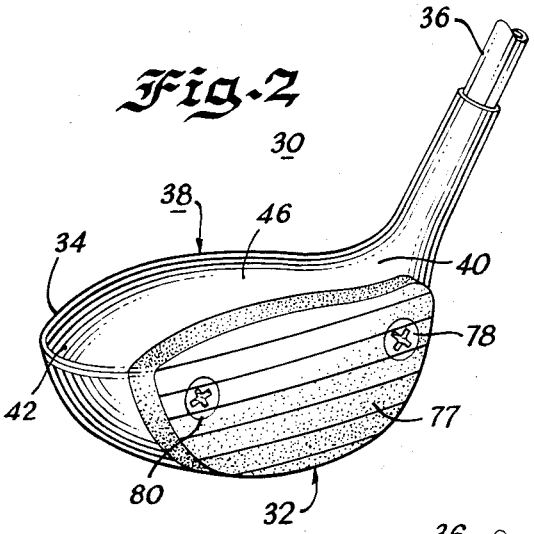
FIG. 2 is a perspective view of the golf club head of the present invention.
Figure 4:
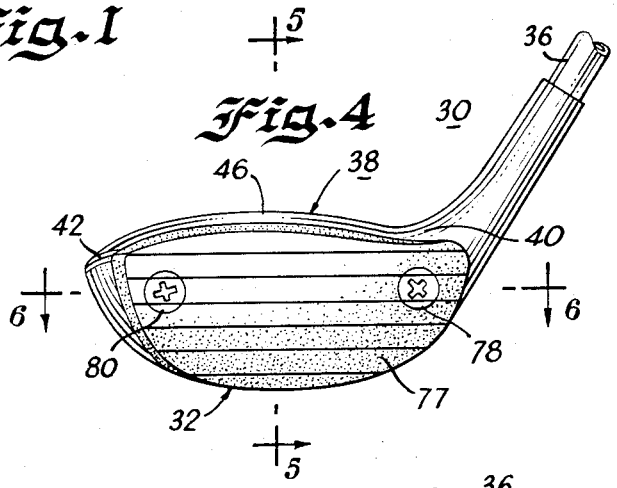
FIG. 4 is a front, elevational view of one embodiment of the golf club head of the present invention.
Figure 3:
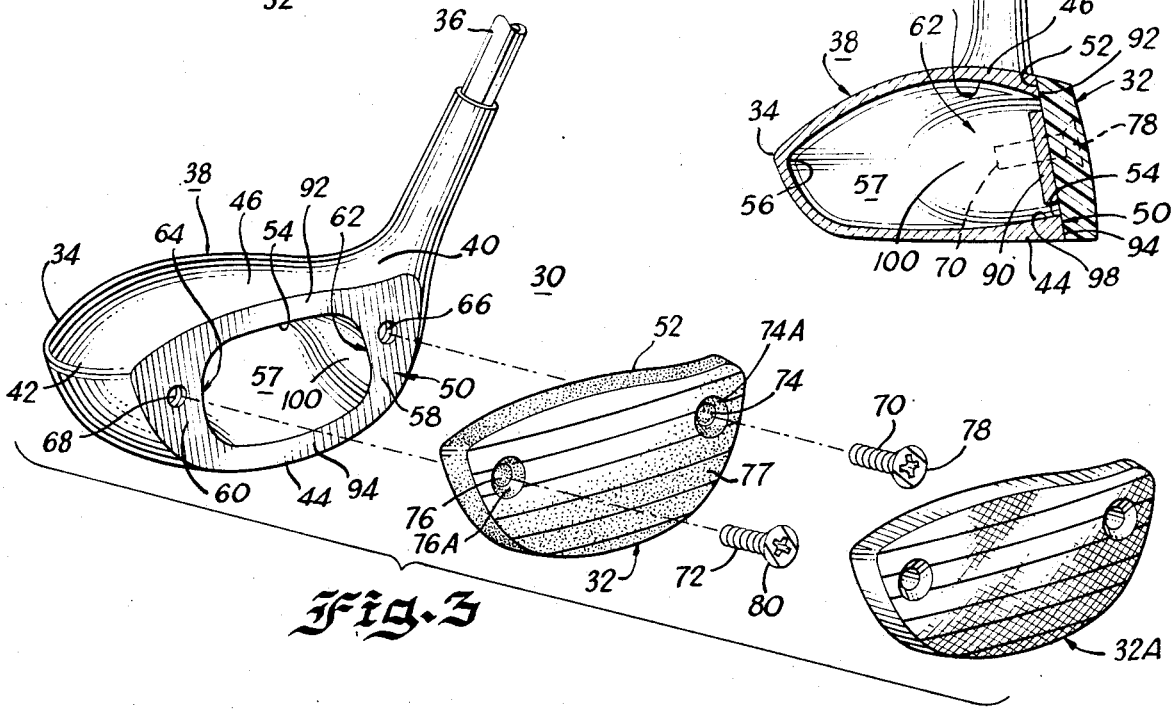
FIG. 3 is an exploded perspective view of a golf club head manufactured in accordance with the principles of the present invention having a plurality of interchangeable face plates of different materials loft, bulge and/or roll forming a golf club kit.

As shown, for example, in FIGS. 2 and 3, the golf club of the present invention, generally designated 30 is a wood type golf club distinguishable from an iron type golf club in being relatively broad from the face 32 to the back wall 34. The golf club of the present invention generally comprises an elongated shaft 36 connected to or integral with a club head generally designated 38. To achieve the full advantage of the present invention, the golf club head 38 is formed of metal, such as aluminum or a composite (fiber reinforced) polymer. In accordance with an important feature of the present invention, the golf club head 38 includes face plate 32 removable from the remainder of the golf club head 38. The golf club head 38 includes a heel portion 40; a toe portion 42; a sole wall or sole plate 44 forming a bottom wall of the golf clubhead 38; and an upper wall 46. With face plate 32 removed, as shown in FIG. 3, the golf club head 38 includes a generally planar front surface generally designated by reference numeral 50 adapted to receive the removable face plate 32 in mating, flush contact against a rear wall 52 of the removable face plate 32. The planar face plate receiving front surface 50 of the golf club head 38 is generally in the shape of an elongated donut having a central aperture or cavity 54, shaped generally in an oval or rectangular configuration, extending toward the back wall 34 of the golf club head 38 to an inner surface 56 of the golf club head back wall 34 forming a lightweight central core of the golf club head 38, generally designated 57. In accordance with an important feature of the present invention, the heel and toe portions 40 and 42, respectively, of the golf club head 38, are cast with metal or other material or otherwise filled with material, such as aluminum, to provide relatively thick walls 58 and 60 at the planar surface 50 of the club head 38 extending from the front planar surface 50 back toward the inner surface 56 of back wall 34 of the golf club head 38 forming enlarged heel and toe solid members, generally designated 62 and 64, respectively. The solid members 62 and 64 provide substantially more weight at the heel portion 40 and toe portion 42 of the golf club head 38 than in the central, open core portion 57 of the golf club head 38. The core portion 57 is unfilled (air only) or can be filled with a suitable lightweight material, for example a foam, such as a polyurethane or thermoplastic foam.

The solid members 62 and 64 at the heel and toe portions of the golf club head 38, respectively, comprise elongated curvilinear inner heel and toe wall extensions extending (integral with the walls or insertable thereagainst) toward the central club head core portion 57 to provide substantially thicker club head walls at the heel and toe portions than at the upper wall 46 and lower or sole wall 44 and back 34. The thicker wall portions 58 and 60 at the heel and toe of the planer face plate receiving surface 50 include, in a preferred embodiment, threaded apertures 66 and 68 at the heel and toe portions, respectively, adapted to receive a pair of fasteners or screws, such as phillips screws 70 and 72 receivable within apertures 74 and 76 in the removable face plate 32. The screws 70 and 72 are not quickly changeable so that the golf clubs manufactured in accordance with the principles of the present invention comply with the U.S. Golf Association Rules.

The club face apertures 74 and 76 include enlarged or flared truncated cone-shaped screw head receiving surfaces 74A and 76A at a ball striking surface 77 of the face plate 32 so that the heads 78 and 80 of the fasteners 70 and 72 are substantially flush with the ball striking surface 77 of the face plate 32 when the fasteners 70 and 72 are fully received within the threaded apertures 66 and 68 in the planar surface 50 of the club head 38.

In accordance with another important feature of the present invention, the interchangeable face plates 32 can be formed from a variety of materials to provide varied swing weights; and to provide varied hardnesses and stiffnesses to the ball contacting surface 77 to provide various compression effects to the interchangeable face plates 32. The face plates 32 can be made from various materials, for example: graphite; epoxies; composite materials such as epoxies filled with strengthening fibers such as fiberglass, graphite and the like; unsaturated polyesters; composite materials comprising unsaturated polyesters filled with various amounts of fibrous fillers such as fiberglass or graphite; ceramic materials; thermoplastics such as linear polyethylene; metals such as aluminum, stainless steel, magnesium, or various suitable alloys; acrylonitrilebutadiene-styrene-epoxy or other polymer composite materials, and the like. Some of these materials are more suitable for face plates depending upon different conditions of temperature and different golf enthusiast's talents or lack thereof.

In accordance with another important feature of the present invention, as shown in FIGS. 6 and 7, the interchangeable face plates 32 can be weighted by securing a suitable weight 90 to the back of the club head contacting surface 52 of the face plate 32. It has been found that a weight secured centrally behind a desired ball striking area 77 on a face plate 32, as shown in FIG. 6 and 7, enables the golf enthusiast to transmit the energy more directly into the balls.

In accordance with an important feature of the present invention, as best shown in FIG. 3, a golf club kit is provided including a wood type golf club having a metal club head 38 and a plurality of face plates 32 and 32A. As shown in FIG. 3, face plate 32A is formed from a different material than face plate 32. Similarly, a plurality of face plates can be provided in a golf club kit having different specifications for loft, bulge and/or roll.

Figure 5:
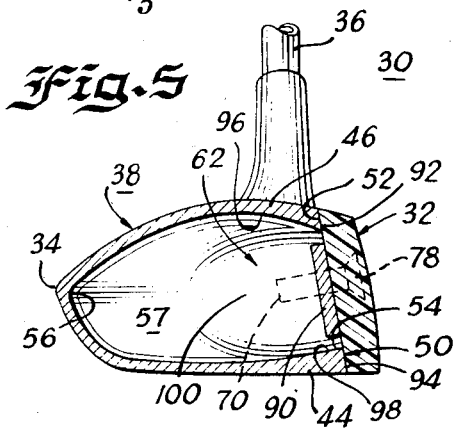
FIG. 5 is a cross-sectional view of one embodiment of the golf club head of the present invention taken along line 5—5 of FIG. 4.

In accordance with one important embodiment of the present invention, as best shown in FIGS. 3 and 5, the golf club head 38 of the present invention includes an enlarged upper wall surface 92 and an enlarged lower wall surface 94 to achieve better support for and mating contact against the rear wall 52 of the removable face plates 32 or 32A. As shown in FIG. 5, the enlarged upper and lower wall surfaces 92 and 94 are formed or cast as an integral part of upper and lower walls 46 and 44, respectively. The enlargement of upper and lower club head walls 46 and 44 at the face plate mating upper and lower surfaces, 92 and 94, respectively, provides more solid engagement of the club head 38 with the face plates 32 or 32A to enable more solid engagement with a golf ball at the resulting enlarged "sweet spot". The enlarged surfaces 92 and 94 are cast or formed by providing converging curvatures to upper and lower inner wall surfaces 96 and 98, respectively, converging in a direction toward the club head front surface 50 to provide enlarged surfaces 92 and 94 thicker than the upper and lower walls 46 and 44 at a point spaced from the front club head surface 50.

In accordance with the embodiment of the present invention best shown in FIGS. 3 and 6, the enlarged heel and toe solid members 62 and 64 of the club head 38 are formed or cast as extensions of inner heel 40 and toe 42 club head walls to form curved inner heel wall 100 and curved inner toe wall 102 each having a curvature from the central aperture 54, at the face plate, toward the heel and toe outer walls to provide a larger cavity at the inner rear club head wall 56 than at the inner face plate wall 52 (see FIG. 6).

The club head 38 can be cast or formed in various desired shapes to the solid heel and toe members 62 and 64 to provide various swing weights and other characteristics to the golf club while maintaining enlarged heel and toe portions 62 and 64, particularly at the front, face plate mating surface 50 of the club head 38. In another embodiment shown in FIG. 7, the heel and toe solid members 62A and 64A are formed having inner walls 100A and 102A formed generally planar from the lower or sole plate club head wall 44 to the upper club head wall 46 to form a generally rectangular central cavity having a curved inner rear wall 56A.

In accordance with another important feature of the present invention, shown in FIG. 7, a face plate 32B can be attached to a club head 38A constructed in accordance with the present invention from a rear wall 34A having fastener receiving apertures 104 and 106 cut into the enlarged heel member 62A and enlarged toe member 64A. Elongated fasteners such as threaded bolts 70A and 72A extend through the heel member 62A and toe member 64A and thread into threaded openings 81 and and 83, respectively in the inner face plate surface 52 to secure the face plate 32B tightly against the front planar surface 50A of the club head 38A. In this manner, the balls striking or front surface 77A of the face plate will not have any fastener receiving apertures which might contact a golf ball when used by an inexperienced golfer.

In accordance with another embodiment of the present invention, as shown in FIGS. 8–11, a club head 38B can be provided with a removable sole plate 110 covering a bottom surface of the club head 38B and a suitable weight 112 can be secured over a centrally disposed elongated club head rib 114 to centrally dispose the weight 112 behind the face plate 32C, as best shown in FIGS. 10 and 11. The weight 112 can be made integral with the central rib 114, or a plurality of interchangeable weights 112 can provide different swing weights to the golf club head 38C. The sole plate 110 is secured over the bottom surface of the club head 38C with fasteners 116 insertable through sole plate apertures 118. The fasteners 116 are received in threaded apertures 120 disposed within the enlarged club head 38C, as shown in FIGS. 9 and 11. In accordance with this embodiment of the invention, a front face plate mating surface 50B of the club head 38B extends completely across the club head from sole plate 110 to an upper club head surface 46B and from heel 40B to toe 42B to assume flush mating contact between a back surface 52B of the face plate 32C and the front planar surface 50B of the club head 38B.

I claim:

1. A wood type golf club comprising:

an elongated shaft; and a metal club head secured to a lower end portion of said shaft, said club head comprising an integrally molded body having a hollow interior with an opening outwardly onto a substantially planar front face; a plurality of interchangeable, ball engaging, metal face plates, each of said plates including a substantially planar back face having a surface and a peripheral edge matching the surface and the peripheral edge around said planar front face of said body; and a plurality of fasteners for securing a selected one of said face plates with its back face held tightly against said front face of said body to close said hollow opening of said club head in readiness for use, each of said face plates having a ball engaging, outer face spaced apart from and opposite said back face, said outer face formed with a set of characteristics including a curved bulge from toe to heel, a curved roll from bottom to top and a degree of angular loft relative to a bottom edge, and at least one of said characteristics of one face plate being different than that of another face plate to impart a different path to a ball when struck thereby, said club head body having spaced apart top and bottom walls extending rearwardly of said front face and a curved back wall spaced rearwardly of said front face integrally joining rearward portions of said top and bottom walls, said body further including spaced apart toe and heel portions extending rearwardly of said front face and integrally joining opposite edge portions of said top and bottom wall and having rearward portions integrally joining upstanding opposite edge portions of said rear wall, said top and bottom walls having a minimum wall thickness adjacent said rearward portion gradually tapering toward a maximum wall thickness at said front face above and below said hollow opening, said toe and heel portions increasing substantially in thickness from said rearward portions joining said rear wall to a maximum wall thickness at said front face which is substantially thicker than said maximum wall thickness of said top and bottom wall measured at a level on said toe and heel portions that is intermediate said top and bottom walls joined therewith.

2. The golf club of claim 1 wherein said toe portion has an outer surface convexly curved between the top and botton and between said front face and said rear wall, said heel portion having an outer surface convexly curved between the top and bottom and between said front face and said rear wall, and wherein said back wall has an outer surface convexly curved between the top and bottom and between said upstanding opposite edge portions joining said heel and toe portions.

3. The golf club of claim 2 wherein said top wall has an outer surface convexly curved between said toe and heel portions and between said front face and said back wall.

4. The golf club of claim 3 wherein said toe and heel portions have inner surfaces curved inwardly toward one another and spaced apart a minimum distance at said front face and a maximum distance where joined with said back wall.

5. The golf club of claim 4 wherein said plurality of fasteners comprises a pair of threaded fasteners extending between said face plate on the one hand and forward portions of said toe and heel portions on the other hand, each having said maximum wall thickness and spaced on opposite sides of said opening on said front face of said club head.

6. The golf club of claim 1 wherein said opening on said front face is oblong in shpe with rounded corners and is surrounded by said maximum wall thickness portion of said top and bottom walls and said toe and heel portions.

* * * * *

UNITED STATES PATENT AND TRADEMARK OFFICE

CERTIFICATE OF CORRECTION

PATENT NO. : 4,618,149

DATED : October 21, 1986

INVENTOR(S) : John M. Maxel

It is certified that error appears in the above-identified patent and that said Letters Patent are hereby corrected as shown below:

Column 10, line 4, "shpe" should read --shape--.

Signed and Sealed this

Third Day of March, 1987

*Attest:*

DONALD J. QUIGG

*Attesting Officer*

*Commissioner of Patents and Trademarks*